US007121123B2

(12) United States Patent
Yu

(10) Patent No.: US 7,121,123 B2
(45) Date of Patent: Oct. 17, 2006

(54) PADLOCK

(76) Inventor: Chun Te Yu, No. 253, Sec. 3, Yanhai Rd., Fusing Township, Changhua County 506 (TW)

( * ) Notice: Subject to any disclaimer, the term of this patent is extended or adjusted under 35 U.S.C. 154(b) by 0 days.

(21) Appl. No.: 11/246,083

(22) Filed: Oct. 11, 2005

(65) Prior Publication Data

US 2006/0027000 A1 Feb. 9, 2006

Related U.S. Application Data

(63) Continuation-in-part of application No. 10/725,549, filed on Dec. 3, 2003, now abandoned.

(51) Int. Cl.
*E05B 37/02* (2006.01)

(52) U.S. Cl. ..... 70/21; 70/25; 70/38 C

(58) Field of Classification Search ..... 70/21, 70/24–26, 284, 285, DIG. 63, DIG. 71, 30, 70/49, 44, 38 R, 38 A, 38 C, 29, 47
See application file for complete search history.

(56) References Cited

U.S. PATENT DOCUMENTS 1,141,827 A * 6/1915 Reidt ..... 70/25
1,390,222 A * 9/1921 Wise ..... 70/38 C
1,597,560 A * 8/1926 Wise ..... 70/38 R
4,462,231 A * 7/1984 Zabel ..... 70/21
4,751,830 A * 6/1988 Cheng ..... 70/25
4,754,623 A * 7/1988 Hwang ..... 70/25
4,899,559 A * 2/1990 Chern ..... 70/25
5,396,785 A * 3/1995 Chen ..... 70/25
6,539,761 B1 * 4/2003 Yang ..... 70/284
6,860,125 B1 * 3/2005 Yu ..... 70/25
7,007,521 B1 * 3/2006 Misner et al. ..... 70/21
2002/0088256 A1 * 7/2002 Taylor et al. ..... 70/25

* cited by examiner

*Primary Examiner*—Lloyd A. Gall
(74) *Attorney, Agent, or Firm*—Rosenberg, Klein & Lee

(57) ABSTRACT

A padlock comprises a lock body, a shackle, a combination locking device and a key locking device. The shackle is movable relative to the lock body between a locked position and an unlocked position. The combination and key locking devices are installed within the lock body respectively for controlling movements of the shackle. Additionally, the combination locking device has a frame for receiving a first end of the shackle and a combination unit connected to the frame, which is movable when the combination unit is unlock whereby a second end of the shackle is movable to the unlock position. Furthermore, the key locking device comprises a block unit for locking the first end of the shackle and a key unit connected to the block unit, which is movable when the key unit is unlocked by a key.

5 Claims, 9 Drawing Sheets

PADLOCK

CROSS REFERENCE TO RELATED APPLICATION

This application is a continuation-in-part application of U.S. application Ser. No. 10/725,549 filed Dec. 3, 2003 now abandoned.

TECHNICAL FIELD

This invention relates generally to a padlock, in particular, to a padlock with dual locking devices.

BACKGROUND OF THE INVENTION

A conventional padlock with either a key locking device or a combination locking device is popular because the padlock with a single locking device is easy to use and such a padlock is provided for individual use only. Generally, travelers would apply different padlocks to lock their luggage so as to protect their personal items. Therefore, authorized security staff would have great difficulties in opening the luggage and checking the personal items due to safety concerns, if the luggage were locked by the padlocks with the single locking devices.

Furthermore, another conventional padlock with dual locking devices, namely with a key and a combination locking devices, is also well-known for satisfying the safety concerns. Substantially, the padlock with the dual locking devices is provided for both individual and security authorities uses. Accordingly, the individual is capable of locking or unlocking their luggage by using one locking device of the padlock, namely the combination locking device, to protect their personal items, and the security authorities are capable of unlocking or locking the luggage by using the other locking device, namely the key locking device, during safety inspections. Thus, the padlock with dual locking devices advantages both the individual and the security authorities.

Because the padlocks with the dual locking devices have greater advantages over the padlocks with the single locking device that would gain a great attention to the public and the authorities, and such padlocks having strong structures and easy operating characteristics are in a great demand.

SUMMARY OF INVENTION

It is therefore an objective of the present invention to provide a padlock, which can be unlocked by either a combination locking device or a key locking device, and also to provide a padlock with strong structures and easy operating characteristics as well.

More specifically, in one embodiment of the present invention, the padlock comprises a lock body, a shackle, a combination locking device and a key locking device. The shackle is movable relative to the lock body between a locked position and an unlocked position. The shackle has a first end movably installed within the lock body and a second end retainable within the lock body in the locked position, and the first end has a stop at a distal end thereof. Furthermore, the combination locking device is installed within the lock body for controlling movements of the shackle. The combination locking device comprises a frame for receiving the first end of the shackle and a combination unit connected to the frame, which is movable upwardly and downwardly when the combination unit is unlocked whereby the second end of the shackle is movable to the unlocked position. Additionally, the frame has a slot, a first opening intercommunicated with the slot for allowing the first end of the shackle to enter therefrom, and a second opening. The key locking device is installed within the lock body for controlling movements of the shackle. The key locking device comprises a block unit for blocking the first end of the shackle from moving, and a key unit connected to the block unit, which is movable when the key unit is unlocked and operated by a key. The block unit has a block end against the stop of the first end through the second opening and a connecting end connected to the key unit.

BRIEF DESCRIPTION OF DRAWINGS

The invention will be more clearly understood after referring to the following detailed description read in conjunction with the drawings wherein.

DETAILED DESCRIPTION OF PREFERRED EMBODIMENTS

Figure 1:
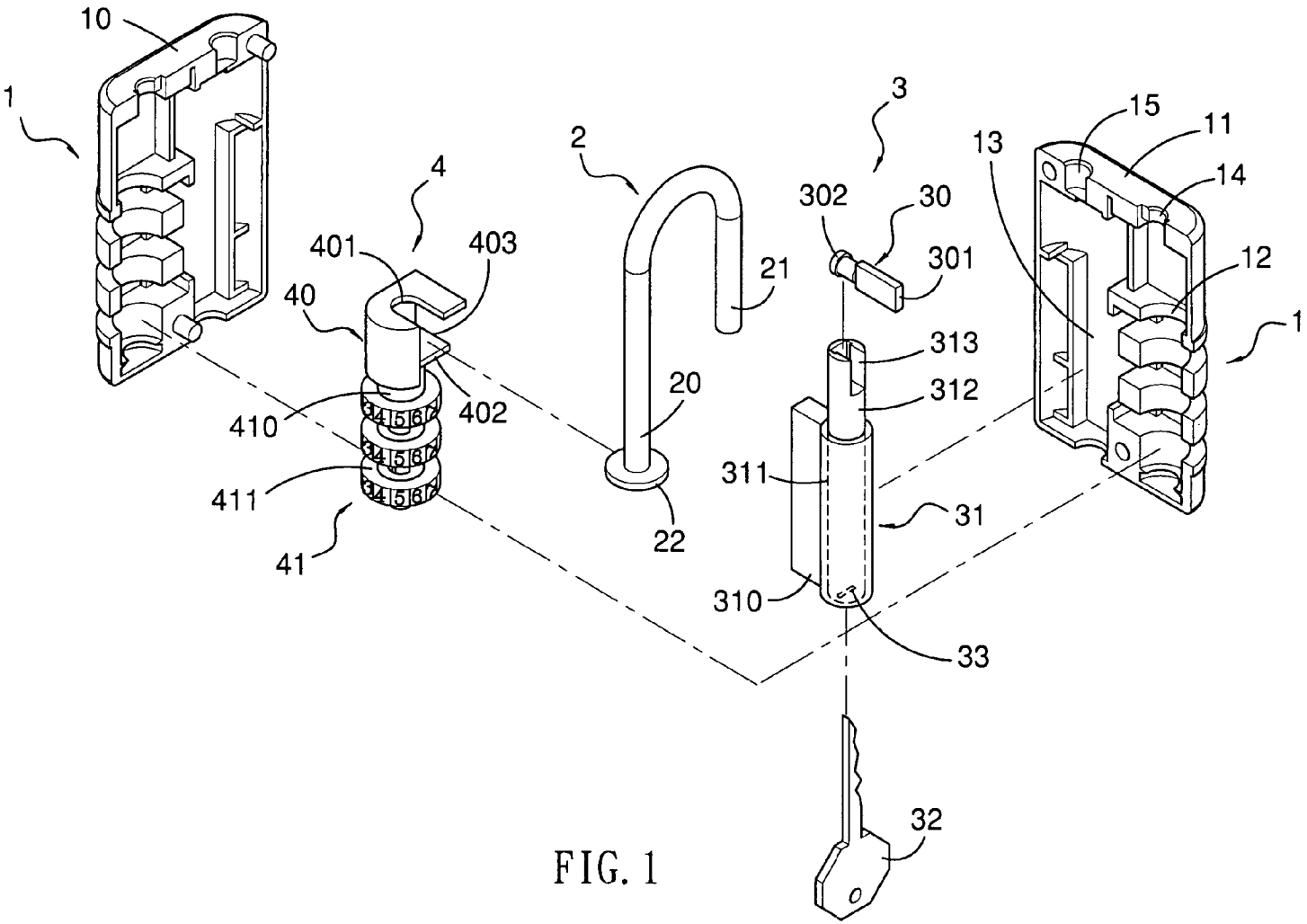
FIG. 1 is an exploded view of a first embodiment of present invention.

FIGS. 1–6 show a padlock as a first embodiment of the present invention. In FIG. 1, the padlock comprises a lock body 1, a shackle 2, a key locking device 3 and a combination locking device 4. The lock body 1 includes a front cover 10 and a back cover 11 integrated with the front cover 10. Additionally, the lock body 1 has a first chamber 12 and a second chamber 13 formed therein; furthermore, the lock body 1 has a hole 14 intercommunicated with the first chamber 12, and a recess 15 formed thereon. The shackle 2 is movable relative to the lock body 1 between a locked position and an unlocked position. Moreover, the shackle 2 has a first end 20 movably installed within of the lock body 1 via the hole 14 and a second end 21 retainable within the recess 15 of the lock body 1 in the locked position. The first end 20 of the shackle 2 has a stop 22 at a distal end thereof.

In addition, the combination locking device 4 is installed within the first chamber 12 of the lock body 1 for controlling movements of the shackle 2 between the locked position and the unlocked position. The combination locking device 4 comprises a frame 40 provided for receiving the first end 20 of the shackle 2, and a combination unit 41 connected to the frame 40, which is movable upwardly and downwardly when the combination unit 41 is unlocked, whereby the second end 21 of the shackle 2 is movable to the unlocked position. Similarly to conventional combination units, the combination unit 41 of the present invention comprises a stem 410 provided for connecting to the frame 40, and a plurality of dials 411 rotatably mounted around the stem 410, which is movable when a set of unlocking numbers of the dials 411 are dialed. Accordingly, the frame 40 is moved synchronously by the stem 410 of the combination unit 41. Moreover, the frame 40 has a slot 401 formed on a top of the frame 40, a first opening 402 intercommunicated with the slot 401 for allowing the first end 20 of the shackle 2 to enter therefrom, and a second opening 403, which is intercommunicated with the first opening 402. In the first embodiment of the present invention, the frame 40 has walls and the slot 401 is preferably formed on a top wall of the frame 40. The first opening 402 is formed on a side of the frame 40 and the second opening 403 is formed on another side of the frame 40 adjacent to the first opening 402 as shown in FIG. 1.

The key locking device 3 is installed within the second chamber 13 of the lock body 1 for controlling movements of the shackle 2 between the locked position and the unlocked position. The key locking device 3 comprises a block unit 30 provided for blocking the first end 20 of the shackle 2 from moving, and a key unit 31 connected to the block unit 30, which is movable when the key unit 31 is unlocked and operated by a key 32. The block unit 30 has a block end 301 against the stop 22 of the first end 20 through the second opening 403 of the frame 40, and a connecting end 302 connected to the key unit 31. Moreover, the key unit 31 comprises a body 310, a rotor 311 installed in the body 310 and having a keyhole 33 at a bottom thereof for inserting the key 32, and a driving rod 312 protruding from the rotor 311 for connecting to the connecting end 302 of the block unit 30. In the first embodiment, the driving rod 312 of the key unit 31 has a notch 313 for receiving the connecting end 302 of the block unit 30. Accordingly, the connecting end 302 of the block unit 30 is movable within the notch 313 of the driving rod 312.

Figure 3:
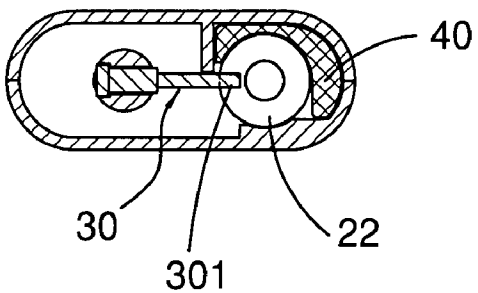
FIG. 3 is a top plan cross-sectional view of the first embodiment, as shown in FIG. 2.
Figure 2:
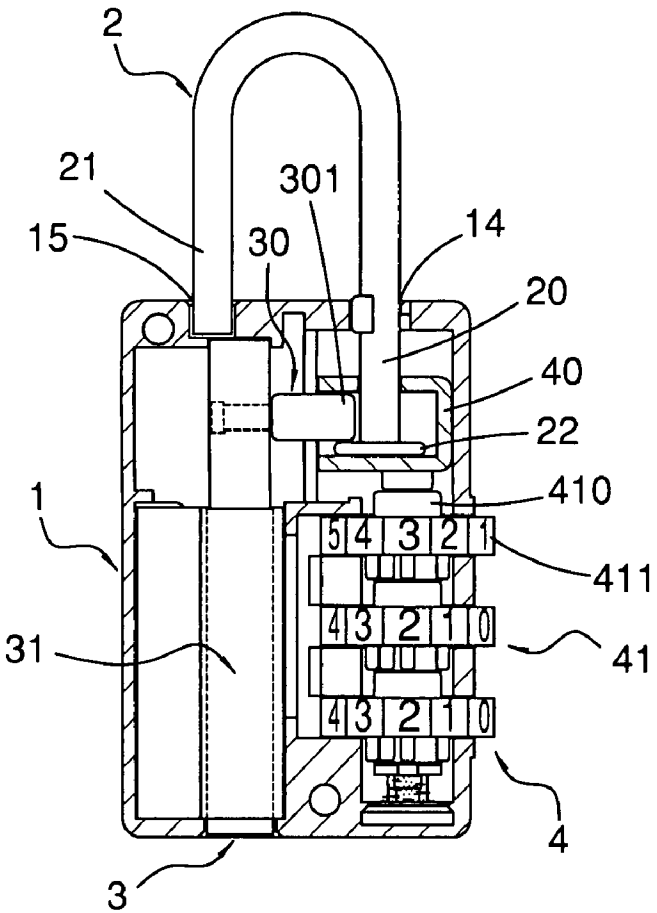
FIG. 2 is a cross-sectional view of the first embodiment, showing a shackle of a padlock being in a locked position.

FIGS. 2–3 show that the padlock of the first embodiment is locked, namely the shackle 2 being in the locked position and the second end 21 of the shackle 2 being retained within the recess 15 of the lock body 1. In the locked position, both the combination locking device 4 and the key locking device 3 are not operated, and the stop 22 of the first end 20 is blocked by the block end 301 of the block unit 30, so as to keep the first end 20 of the shackle 2 from moving. Furthermore, the stem 410 of the combination unit 41 and the frame 40 keep still because the unlocking numbers of the dials 411 are not dialed.

Figure 4:
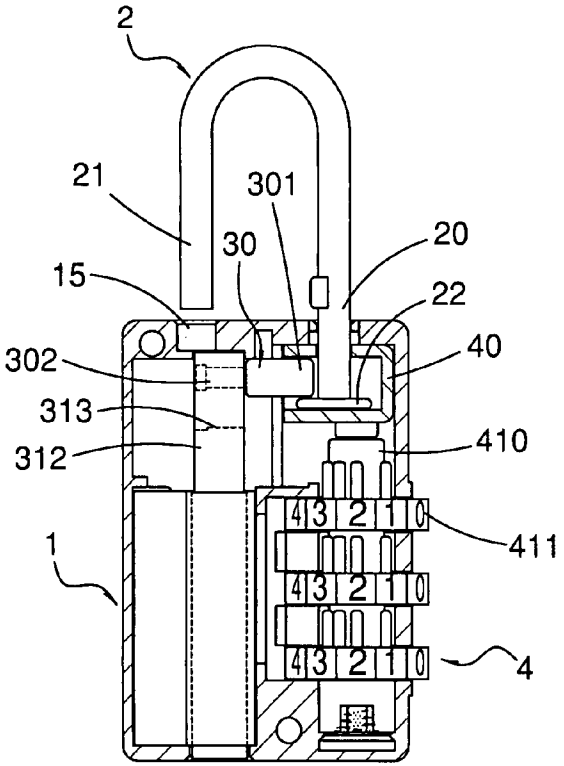
FIG. 4 is a cross-sectional view of the first embodiment, showing the shackle of the padlock is in an unlocked position when a combination unit of a combination locking device is unlocked.

In FIG. 4, the padlock of the first embodiment is unlocked by operating the combination locking device 4. The second end 21 of the shackle 2 is capable of removing from the recess 15 of the lock body 1 after the unlocking numbers of the dials 411 are dialed. When the unlocking numbers of the dials 411 are dialed, the stem 410 is moved upwardly together with the frame 40 and the first end 20 of the shackle 2 to a position where allows the second end 21 of the shackle 2 removing from the recess 15 of the lock body 1; meanwhile, the block unit 30 is moved accordingly and upwardly, due to the block end 301 against the stop 22 of the first end 20 of the shackle 2 and the connecting end 302 movable within the notch 313 of the driving rod 312.

Figure 5:
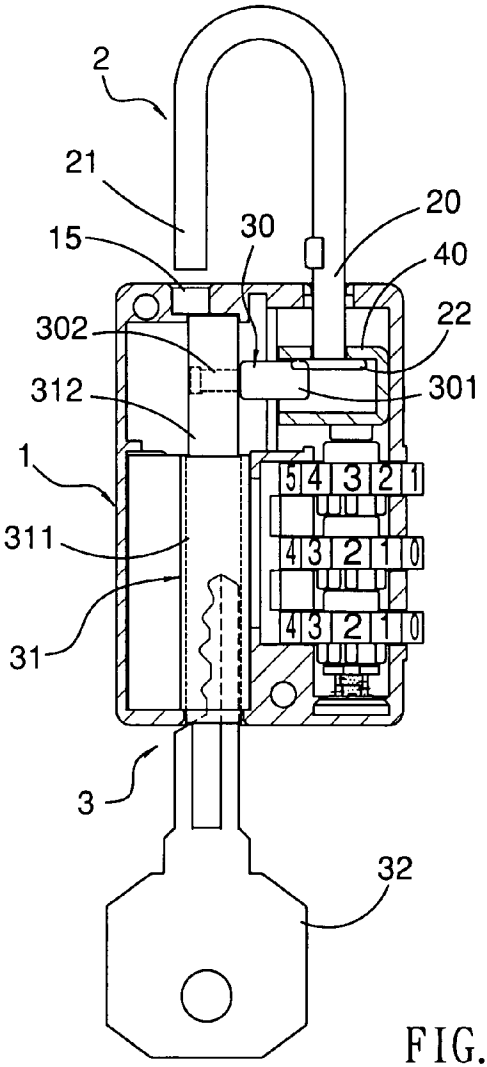
FIG. 5 is a cross-sectional view of the first embodiment, showing the shackle of the padlock is in an unlocked position when a key unit of a key locking device is unlocked by a key.
Figure 6:
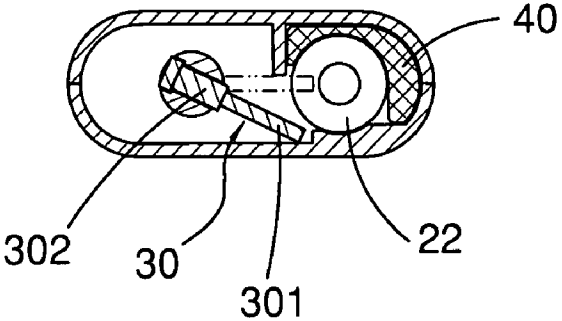
FIG. 6 is a top cross-sectional view of the first embodiment, as shown in FIG. 5.

FIGS. 5–6 show that the padlock of the first embodiment is unlocked by operating the key locking device 3. When the key unit 31 is unlocked and operated by the key 32, the rotor 311 of the key unit 31 is driven and rotated by the key 32 accordingly, and the driving rod 312 is synchronously rotated by the rotor 311. Therefore, the block unit 30 connected to the key unit 31 is capable of rotating to a position where allows the block end 301 of the block unit 30 away from the stop 22 of the first end 20 of the shackle 2, due to the connecting end 302 of the block unit 30 connected to the driving rod 312 of the key unit 31. Since the block end 301 of the block unit 30 is rotated away from the stop 22 of the first end 20 of the shackle 2, the first end 20 of the shackle 2 is movable within the frame 40 so as to allow the second end 21 of the shackle 2 removing from the recess 15 of the lock body 1.

Figure 7:
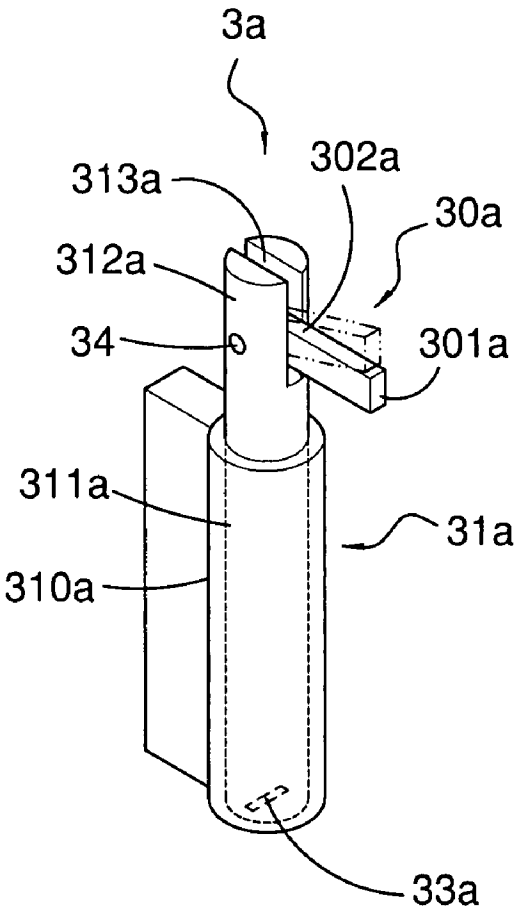
FIG. 7 is a perspective view of a key locking device of a second embodiment of the present invention.
Figure 8:
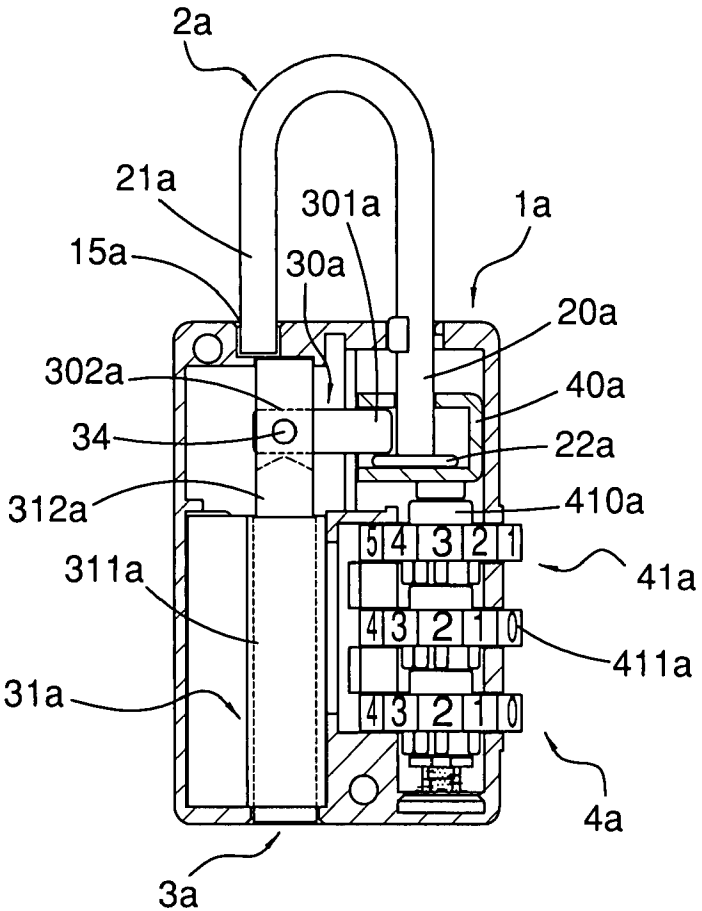
FIG. 8 is a cross-sectional view of the second embodiment, showing a shackle of a padlock being in a locked position.

FIGS. 7–12 show a padlock as a second embodiment of the present invention, and the padlock of the second embodiment has same structures as the padlock of the first embodiment except the key locking device 3. As shown in FIGS. 7–8, the padlock of the second embodiment comprises a lock body 1*a*, a shackle 2*a*, a key locking device 3*a* and a combination locking device 4*a*. Similarly to the first embodiment, the lock body 1*a* has a recess 15*a*, the shackle 2*a* has a first end 20*a* with a stop 22*a* and a second end 21*a*, and the combination locking device 4*a* comprises a frame 40*a* and a combination unit 41*a*, which comprises a stem 410*a* and a plurality of dials 411*a*. Additionally, the key locking device 3*a* comprises a block unit 30*a* provided for blocking the first end 20*a* of the shackle 2*a* from moving, and a key unit 31*a* connected to the block unit 30*a*.

In FIG. 7, the block unit 30*a* has a block end 301*a* and a connecting end 302*a*, and the key unit 31*a* comprises a body 310*a*, a rotor 311*a* installed in the body 310*a* and having a keyhole 33*a* at a bottom thereof, and a driving rod 312*a* protruding from the rotor 311*a* for connecting to the connecting end 302*a* of the block unit 30*a*. Furthermore, the driving rod 312*a* of the key unit 31*a* has a notch 313*a* provided for receiving the connecting end 302*a* of the block unit 30*a*. Differently to the first embodiment, the connecting end 302*a* of the block unit 30*a* is pivotally connected to the driving rod 312*a* of the key unit 31*a* by a pin 34, which allows the block unit 30*a* to swing. Regarding to pivotal connections between the connecting end 302*a* of the block unit 30*a* and the driving rod 312*a* of the key unit 31*a*, the connecting end 302*a* is preferably received within the notch 313*a* as shown in the second embodiment. However, it is known that such connections also could be completed by any conventional pivotal techniques. For examples, the driving rod 312*a* could be formed into a plate shape, and the connecting end 302*a* could be formed into any suitable shape to the driving rod 312*a* so as to be pivotally connected to the driving rod 312*a* by any connecting member.

Figure 9:
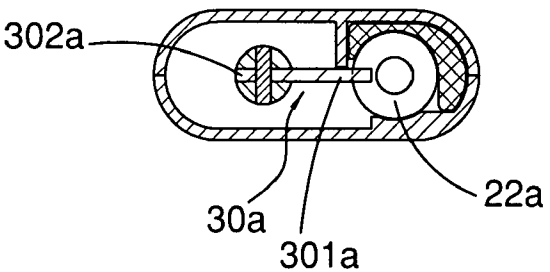
FIG. 9 is a top plan cross-sectional view of the second embodiment, as shown in FIG. 8.

FIGS. 8–9 show that the padlock of the second embodiment is locked. In the locked position, both the combination locking device 4*a* and the key locking device 3*a* are not operated, and the stop 22*a* of the first end 20*a* is blocked by the block end 301*a* of the block unit 30*a* so as to keep the first end 20*a* of the shackle 2*a* from moving. Furthermore, the stem 410*a* of the combination unit 41*a* and the frame 40*a* keep still because the unlocking numbers of the dials 411*a* are not dialed.

Figure 10:
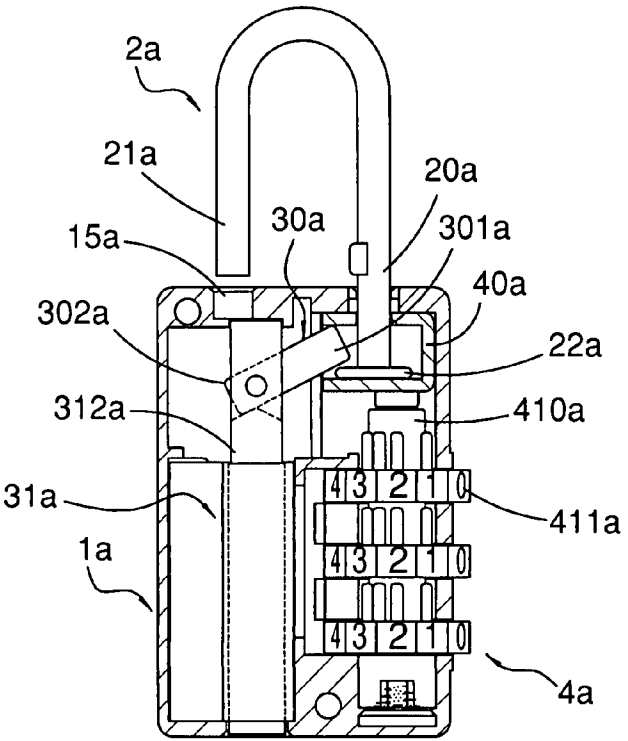
FIG. 10 is a cross-sectional view of the second embodiment, showing the shackle of the padlock is in an unlocked position when a combination unit of a combination locking device is unlocked.

In FIG. 10, the padlock of the second embodiment is unlocked by operating the combination locking device 4*a*. Similarly to the first embodiment, the second end 21*a* of the shackle 2*a* is capable of removing from the recess 15*a* of the lock body 1*a* after the unlocking numbers of the dials 411*a* are dialed. When the unlocking numbers of the dials 411*a* are dialed, the stem 410*a* is moved upwardly together with the frame 40*a* and the first end 20*a* of the shackle 2*a* to a position where allows the second end 21*a* of the shackle 2*a* removing from the recess 15*a* of the lock body 1*a*; meanwhile, the block unit 30*a* is swung to an angle accordingly, due to the block end 301*a* against the stop 22*a* of the first end 20*a* of the shackle 2*a*, and the connecting end 302*a* pivotally connected to the driving rod 312*a* of the key unit 31*a*.

Figure 11:
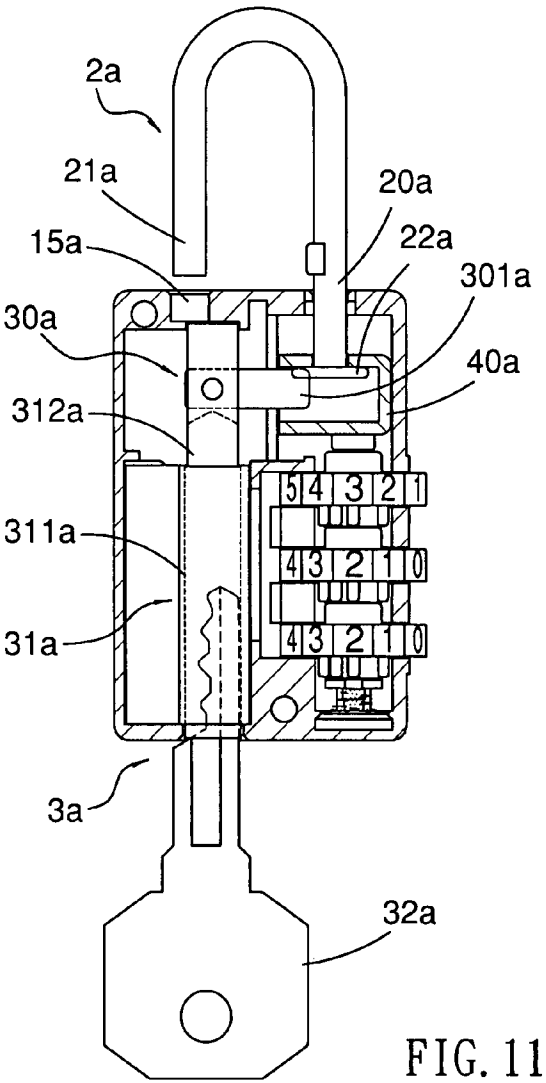
FIG. 11 is a cross-sectional view of the second embodiment, showing the shackle of the padlock is in an unlocked position when a key unit of the key locking device is unlocked by a key.
Figure 12:
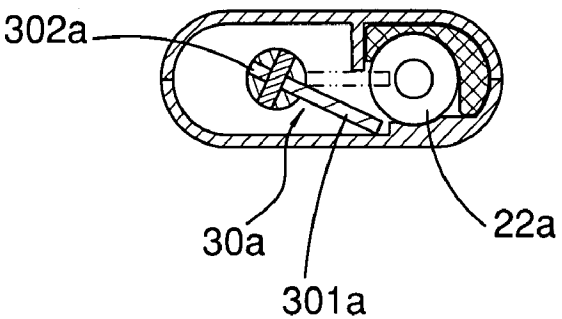
FIG. 12 is a top cross-sectional view of the second embodiment, as shown in FIG. 11.

FIGS. 11–12 show that the padlock of the second embodiment is unlocked by operating the key locking device 3*a*. When the key unit 31*a* is unlocked and operated by the key 32*a*, the rotor 311*a* of the key unit 31*a* is driven and rotated by the key 32*a* accordingly, and the driving rod 312*a* is synchronously rotated by the rotor 311*a*. Therefore, the block unit 30*a* connected to the key unit 31*a* is capable of rotating to a position where allows the block end 301*a* of the block unit 30*a* removing away from the stop 22*a* of the first end 20*a* of the shackle 2*a*, as shown in FIG. 12. Since the block end 301*a* of the block unit 30*a* is rotated away from the stop 22*a*, the first end 20*a* of the shackle 2*a* is movable within the frame 40*a* so as to allow the second end 21*a* of the shackle 2*a* removing from the recess 15*a* of the lock body 1*a*.

Figure 13:
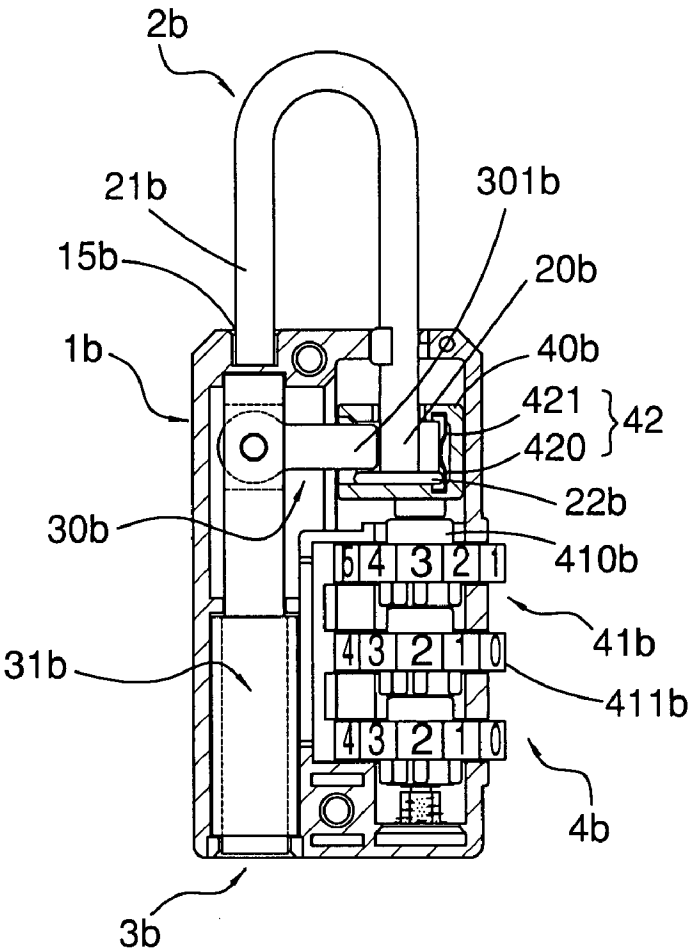
FIG. 13 is a cross-sectional view of a third embodiment of the present invention, showing a shackle of a padlock being in a locked position.

FIGS. 13–17 show a padlock as a third embodiment of the present invention, and the third embodiment has same structures as the padlock of the second embodiment except the combination locking device 4*a*. As shown in FIG. 13, the padlock of the third embodiment also comprises a lock body 1*b*, a shackle 2*b*, a key locking device 3*b* and a combination locking device 4*b*. Similarly to the second embodiment, the lock body 1*b* has a recess 15*b*, the shackle 2*b* has a first end 20*b* with a stop 22*b* and a second end 21*b*, the key locking device 3*b* comprises a block unit 30*b* provided for blocking the first end 20*b* of the shackle 2*b* from moving, and a key unit 31*b* connected to the block unit 30*b*. Differently to the combination locking device 4*a* of the second embodiment, the combination locking device 4*b* of the third embodiment comprises a frame 40*b*, a spring plate 42 installed within a wall of the frame 40*b*, and a combination unit 41*b*, which comprises a stem 410*b* and a plurality of dials 411*b*. Furthermore, the spring plate 42 has two bends 420, 421 at two ends thereof respectively, namely a lower bend 420 and an upper bend 421, and the two bends 420, 421 of the spring plate 42 are provided for retaining the stop 22*b* of the first end 20*b* of the shackle 2*b* respectively when the shackle 2*b* moves to either one of the locked position and the unlocked position.

Figure 14:
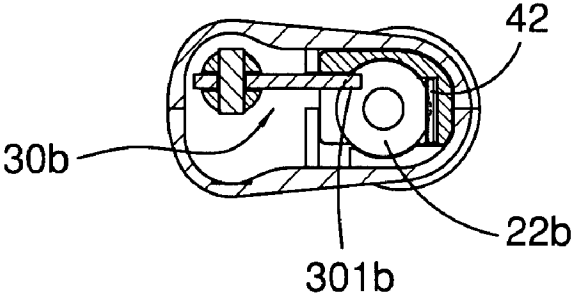
FIG. 14 is a top cross-sectional view of the third embodiment, as shown in FIG. 13.

FIGS. 13–14 show that the padlock of the third embodiment is locked. In the locked position, both the combination locking device 4*b* and the key locking device 3*b* are not operated, and the stop 22*b* of the first end 20*b* is blocked by the block end 301*b* of the block unit 30*b* so as to keep the first end 20*b* of the shackle 2*b* from moving. Meanwhile, the stop 22*b* of the first end 20*b* is retained in the lower bend 420 of the spring plate 42 to keep the stop 22*b* of the first end 20*b* in position.

Figure 15:
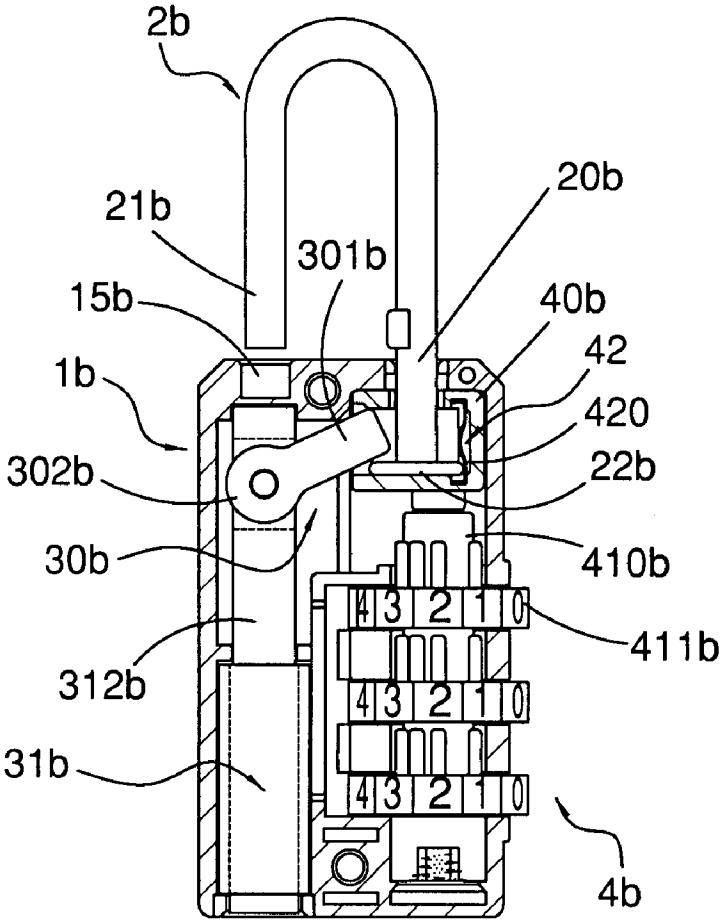
FIG. 15 is a cross-sectional view of the third embodiment, showing the shackle of the padlock is in an unlocked position when a combination unit of a combination locking device is unlocked.

In FIG. 15, the padlock of the third embodiment is unlocked by operating the combination locking device 4*b*. Similarly to the second embodiment, the second end 21*b* of the shackle 2*b* is capable of removing from the recess 15*b* of the lock body 1*b* after the unlocking numbers of the dials 411*b* are dialed. When the unlocking numbers of the dials 411*b* are dialed, the stem 410*b* is moved upwardly together with the frame 40*b* and the first end 20*b* of the shackle 2*b* to a position where allows the second end 21*b* of the shackle 2*b* removing from the recess 15*b* of the lock body 1*b*; meanwhile, the block unit 30*b* is swung to an angle accordingly, due to the block end 301*b* against the stop 22*b* of the first end 20*b*, and the connecting end 302*b* pivotally connected to the driving rod 312*b* of the key unit 31*b*.

Figure 17:
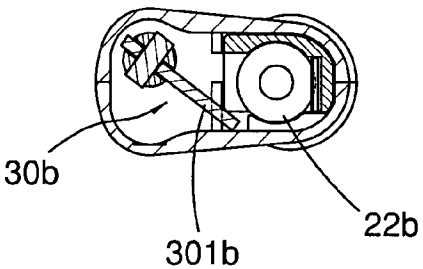
FIG. 17 is a top cross-sectional view of the third embodiment, as shown in FIG. 16.
Figure 16:
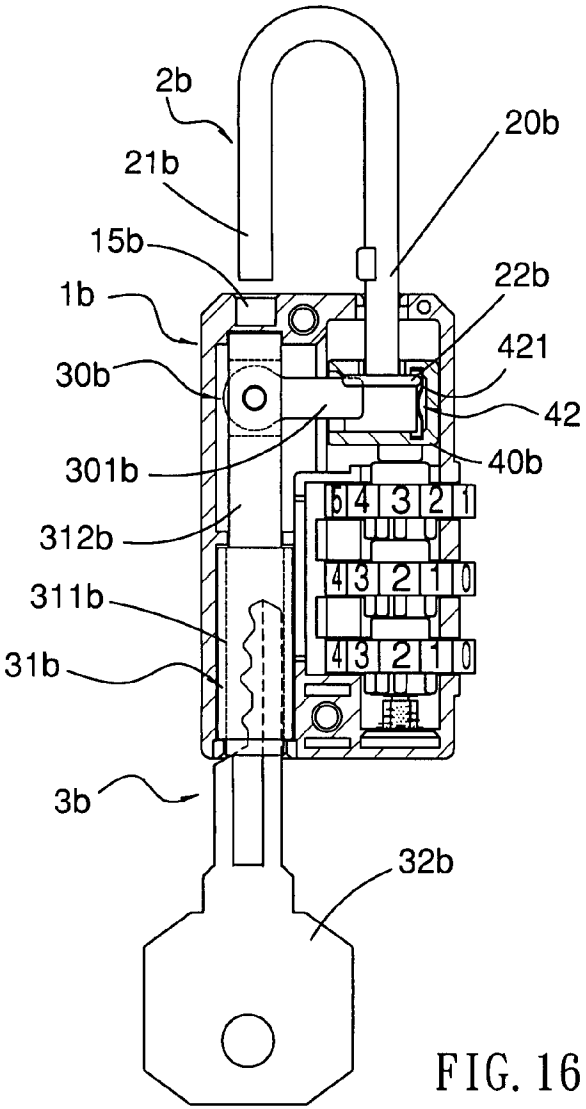
FIG. 16 is a cross-sectional view of the third embodiment, showing the shackle of the padlock is in an unlocked position when a key unit of a key locking device is unlocked by a key.

FIGS. 16–17 show that the padlock of the third embodiment is unlocked by operating the key locking device 3*b*. Similarly to the second embodiment, when the key unit 31*b* is unlocked and operated by the key 32*b*, the rotor 311*b* of the key unit 31*b* is driven and rotated by the key 32*b* accordingly, and the driving rod 312*b* is synchronously rotated by the rotor 311*b*. Therefore, the block unit 30*b* connected to the key unit 31*b* is capable of rotating to a position where allows the block end 301*b* of the block unit 30*b* removing away from the stop 22*b* of the first end 20*b* of the shackle 2*b*, as shown in FIG. 17. Since the block end 301*b* of the block unit 30*b* is rotated away from the stop 22*b*, the first end 20*b* of the shackle 2*b* is movable within the frame 40*b* so as to have the second end 21*b* of the shackle 2*b* removed from the recess 15*b* of the lock body 1*b*. Meanwhile, the stop 22*b* of the first end 20*b* is moved and retained in the upper bend 421 of the spring plate 42 to keep the stop 22*b* of the first end 20*b* in position.

Numerous characteristics and advantages of the invention have been set forth in the foregoing description, together with details of the structure and function of the invention, and the novel features thereof are pointed out in appended claims. The disclosure, however, is illustrated only, and changes may be made in detail, especially, in matters of shape, size and arrangement of parts, materials and the combination thereof within the principle of the invention, to the full extent indicated by the broad general meaning of the terms in which the appended claims are expressed.

I claim:

1. A padlock comprising:

a lock body;

a shackle movable relative to the lock body between a locked position and an unlocked position, the shackle having a first end movably installed within the lock body and a second end retainable within the lock body in the locked position, wherein the first end has a stop at a distal end thereof;

a combination locking device installed within the lock body for controlling movements of the shackle, wherein the combination locking device comprises a frame provided for receiving the first end of the shackle and a combination unit connected to the frame, which is movable upwardly and downwardly when the combination unit is unlocked, whereby the second end of the shackle is movable to the unlocked position, wherein the frame has a slot, a first opening intercommunicated with the slot for allowing the first end of the shackle to enter therefrom, and a second opening; and a key locking device installed within the lock body for controlling movements of the shackle, wherein the key locking device comprises a block unit for blocking the first end of the shackle from moving and a key unit connected to the block unit, which is movable when the key unit is unlocked by a key, wherein the block unit has a block end against the stop of the first end through the second opening and a connecting end connected to the key unit.

2. The padlock of claim 1, wherein the key unit comprises a body, a rotor installed in the body and a driving rod protruding from the rotor for connecting to the connecting end of the block unit.

3. The padlock of claim 2, wherein the connecting end of the block unit is pivotally connected to the driving rod of the key unit.

4. The padlock of claim 2, wherein the driving rod of the key unit has a notch for receiving the connecting end of the block unit, whereby the connecting end of the block unit is movable within the notch.

5. The padlock of claim 3, wherein the combination locking device further comprises a spring plate installed within the frame, the spring plate having two bends at two ends thereof respectively, and the two bends of the spring plate are provided for retaining the stop of the first end of the shackle when the shackle moves to either one of the locked position and the unlocked position.

* * * * *